US010280514B2

(12) United States Patent
Miao et al.

(10) Patent No.: US 10,280,514 B2
(45) Date of Patent: May 7, 2019

(54) FABRICATION OF MIRROR-LIKE COATINGS

(71) Applicant: S.T. Trading Company Limited, Hong Kong (CN)

(72) Inventors: Jianying Miao, Hong Kong (CN); Wei Li, Hong Kong (CN); Shing Hang Ng, Hong Kong (CN); Lok Hang Keung, Hong Kong (CN); Tao Gong, Foshan (CN)

(73) Assignee: S.T. Trading Company Limited, Hong Kong (CN)

( * ) Notice: Subject to any disclaimer, the term of this patent is extended or adjusted under 35 U.S.C. 154(b) by 403 days.

(21) Appl. No.: 14/850,973

(22) Filed: Sep. 11, 2015

(65) Prior Publication Data

US 2016/0047051 A1 Feb. 18, 2016

Related U.S. Application Data

(63) Continuation-in-part of application No. 13/469,605, filed on May 11, 2012, now abandoned.

(60) Provisional application No. 61/457,727, filed on May 20, 2011.

(51) Int. Cl.

| | |
|---|---|
| ***C23C 18/16*** | (2006.01) |
| ***C23C 18/44*** | (2006.01) |
| ***C23C 18/18*** | (2006.01) |
| ***B05D 5/06*** | (2006.01) |
| ***B05D 7/00*** | (2006.01) |

(52) U.S. Cl.

CPC ..... *C23C 18/1689* (2013.01); *B05D 5/068* (2013.01); *B05D 7/56* (2013.01); *C23C 18/1844* (2013.01); *C23C 18/44* (2013.01); *B05D 2202/00* (2013.01); *B05D 2504/00* (2013.01)

(58) Field of Classification Search

CPC . C23C 18/31; C23C 18/1633; C23C 18/1689; C23C 18/1844; C23C 18/44; C23C 18/1831; B05D 5/068; B05D 2202/00; B05D 2504/00; B05D 2420/01; B05D 7/56

See application file for complete search history.

(56) References Cited

U.S. PATENT DOCUMENTS

| | | | | |
|---|---|---|---|---|
| 4,332,857 A * | 6/1982 | Taniyama | ..... | B05D 7/02 427/164 |
| 4,737,188 A | 4/1988 | Bahls | | |
| 5,578,347 A * | 11/1996 | Chan | ..... | B05D 7/16 427/336 |
| 9,205,455 B2 * | 12/2015 | Miao | ..... | B44F 1/02 |

(Continued)

FOREIGN PATENT DOCUMENTS

| | | | | |
|---|---|---|---|---|
| CN | 101432373 | 5/2009 | | |
| WO | WO-2013146293 A1 * | 10/2013 | ..... | C23C 18/285 |

OTHER PUBLICATIONS

Jiang, et al "Chemical Silver Plating and Its Application to Textile Fabric Design", Journal of Applied Polymer Science, vol. 96, (2005), pp. 919-926.*

*Primary Examiner* — Katherine A Bareford

(74) *Attorney, Agent, or Firm* — Eagle IP Limited; Jacqueline C. Lui

(57) ABSTRACT

This invention relates to an object with electroless plated coatings that includes an adhesion coating, a smoothening coating, a silver coating and an anti-scratch coating. A method of fabricating the electroless plated object is also described.

19 Claims, 10 Drawing Sheets

(56) References Cited

U.S. PATENT DOCUMENTS

| | | | | |
|---|---|---|---|---|
| 2003/0108751 | A1* | 6/2003 | Hasegawa | C23C 18/28 428/458 |
| 2006/0014024 | A1 | 1/2006 | Itakura et al. | |
| 2008/0014362 | A1* | 1/2008 | Kawamura | C23C 18/1651 427/443.1 |
| 2009/0220696 | A1* | 9/2009 | Chung | B05D 5/068 427/258 |
| 2012/0295121 | A1* | 11/2012 | Miao | C23C 18/1844 428/450 |
| 2015/0024215 | A1* | 1/2015 | Utsumi | C23C 18/285 428/418 |
| 2015/0140340 | A1* | 5/2015 | Miao | C25D 11/12 428/416 |
| 2015/0190845 | A1* | 7/2015 | Miao | B44F 1/02 428/414 |

* cited by examiner

SGS

Test Report No. HKGEC1200673801 Date: 19 Jun 2012 Page 2 of 5

Test Results :

Test Part Description :

| Specimen No. | SGS Sample ID | Description |
|---|---|---|
| 1 | HKG12-006738.001 | Translucent Yellow Plastic w/ Golden and Blue Coating |

Remarks :

(1) 1 mg/kg = 1 ppm = 0.0001%

(2) MDL = Method Detection Limit (3) ND = Not Detected ( < MDL )

(4) "-" = Not Regulated

RoHS Directive 2011/65/EU

Test Method : With reference to IEC 62321:2008

(1) Determination of Cadmium by ICP-OES/AAS.

(2) Determination of Lead by ICP-OES/AAS.

(3) Determination of Mercury by ICP-OES/AAS.

(4) Determination of Hexavalent Chromium by Colorimetric Method using UV-vis Spectrophotometer.

(5) Determination of PBB / PBDE content by GC-MS.

Fig. 8A

| Test Item(s) | Limit | Unit | MDL | *001* |
|---|---|---|---|---|
| Cadmium (Cd) | 100 | mg/kg | 2 | ND |
| Lead (Pb) | 1,000 | mg/kg | 2 | ND |
| Mercury (Hg) | 1,000 | mg/kg | 2 | ND |
| Hexavalent Chromium (CrVI) | 1,000 | mg/kg | 2 | ND |
| Sum of PBBs | 1,000 | mg/kg | - | ND |
| Monobromobiphenyl | - | mg/kg | 5 | ND |
| Dibromobiphenyl | - | mg/kg | 5 | ND |
| Tribromobiphenyl | - | mg/kg | 5 | ND |
| Tetrabromobiphenyl | - | mg/kg | 5 | ND |
| Pentabromobiphenyl | - | mg/kg | 5 | ND |
| Hexabromobiphenyl | - | mg/kg | 5 | ND |
| Heptabromobiphenyl | - | mg/kg | 5 | ND |
| Octabromobiphenyl | - | mg/kg | 5 | ND |
| Nonabromobiphenyl | - | mg/kg | 5 | ND |
| Decabromobiphenyl | - | mg/kg | 5 | ND |
| Sum of PBDEs | 1,000 | mg/kg | - | ND |

Fig. 8B

SGS

Test Report No. HKGEC1200673801 Date: 19 Jun 2012 Page 3 of 5

| Test Item(s) | Limit | Unit | MDL | 001 |
|---|---|---|---|---|
| Monobromodiphenyl ether | - | mg/kg | 5 | ND |
| Dibromodiphenyl ether | - | mg/kg | 5 | ND |
| Tribromodiphenyl ether | - | mg/kg | 5 | ND |
| Tetrabromodiphenyl ether | - | mg/kg | 5 | ND |
| Pentabromodiphenyl ether | - | mg/kg | 5 | ND |
| Hexabromodiphenyl ether | - | mg/kg | 5 | ND |
| Heptabromodiphenyl ether | - | mg/kg | 5 | ND |
| Octabromodiphenyl ether | - | mg/kg | 5 | ND |
| Nonabromodiphenyl ether | - | mg/kg | 5 | ND |
| Decabromodiphenyl ether | - | mg/kg | 5 | ND |

Notes :

(1) The maximum permissible limit is quoted from directive 2011/65/EU, Annex II

Fig. 8C

FABRICATION OF MIRROR-LIKE COATINGS

CROSS-REFERENCE TO RELATED APPLICATION

This application is a continuation-in-part application of U.S. Non-provisional application Ser. No. 13/469,605 filed on May 11, 2012, which claims priority to U.S. Provisional Application No. 61/457,727, filed on May 20, 2011, which are incorporated herein by reference in its entirety for all purposes. The U.S. Non-provisional application Ser. No. 13/469,605 is abandoned.

FIELD OF THE INVENTION

The invention pertains to multi-layer coatings useful for providing a decorative and durable mirror-like finish on various types of metal substrates. In particular, the coatings are deposited on the metal substrates by an electroless coating method.

BACKGROUND OF THE INVENTION

One conventional metal surface treatment method is electroplating, which supplies the performances of anti-corrosion, hardness, durability and mirror-like gloss together with other accessorial treatment. However, electroplating is potentially harmful to the environment owing to the large quantity of toxic byproducts and wastes that is generated. The whole process therefore operates at high cost. This limits and blocks the further development of the electroplating industry. The development of alternative techniques for achieving functional mirror-like coating on target metals, including steel Q195-A and zinc alloy #3, which are low cost and environmentally friendly is therefore desirable.

SUMMARY OF THE INVENTION

The present invention provides a coating system having at least three layers which is capable of achieving a multiple function mirror-like coating on metals such as steel and zinc alloy (zinc alloy #3 and steel Q 195-A). The three layers include a base coating of epoxy, which provides anti-corrosion protection for metal surfaces and enhances the adhesion of the mirror-like coating which is also applied to the substrate. The decorative mirror-like coating may be formed on the base coating by the reaction of silver salt solution and glucose solution. A surface coating is fabricated on the middle mirror-like coating layer, which protects the mirror-like coating from being oxidized and scratched. The entire coating system is low in cost and easily adaptable to mass production. The processes of coating mixture preparation and the coating layers are all environmentally friendly.

In one embodiment, the invention furnishes a method of providing a substrate with a multi-layer coating, the method comprising the steps of:

a) forming a base coating comprised of epoxy on a surface of the substrate;

b) forming a decorative mirror-like coating on the base coating by reacting an amine complex of silver, a reducing sugar and an acetylenic compound; and c) forming a surface coating on the decorative mirror-like coating which is capable of protecting the decorative mirror-like coating against scratching.

Another aspect of the invention provides a substrate having a multi-layer coating on at least one surface, the multi-layer coating comprising a base coating comprised of cured epoxy, a decorative mirror-like coating comprised of silver on top of the base coating, and a surface coating comprised of polysilicone on top of the decorative mirror-like coating.

In a further aspect of this invention, an object with electroless plated coatings is provided that includes (a) an adhesion coating on the surface of the object having a first silane-based coupling agent;

(b) a smoothening coating on the adhesion layer having epoxy;

(c) a silver coating on the smoothening layer having silver nanoparticles; and (d) an anti-scratch coating on the silver coating having a second silane-based coupling agent.

In one exemplary embodiment, the first silane-based coupling agent is γ-aminopropyltriethoxysilane; the second silane-based coupling agent is 3-mercaptopropyltrimethoxysilane.

In another aspect of this invention, there is provided a method of electroless plating an object, including the steps of (a) applying an adhesion coating, having a first silane-based coupling agent, the surface of the object;

(b) applying a smoothening coating, having epoxy, on the adhesion coating;

(c) applying a silver coating, having silver nanoparticles, on the smoothening coating; and (d) applying an anti-scratch coating, having a second silane-based coupling agent, on the silver coating.

In yet another aspect, an adhesive for adhering an epoxy-based mixture onto a substrate includes epoxy E-51, BYK-361N (BYK-361N is a known polyacrylate), ethanol, acetone and TZ-550 (TZ-550 is a known phenolic aldehyde amine crosslinking agent). In another exemplary embodiment, the weight percentages of the components of the adhesive are listed in Table 1A and 1B. In yet another exemplary embodiment, the substrate is plastic, metal, or any material that reacts with silane.

In an even further aspect of the invention, a composition for smoothening the surface of an object is provided, which includes epoxy. In one exemplary embodiment, the epoxy is epoxy E-51.

In one exemplary embodiment, the composition further includes a leveling agent; in another exemplary embodiment, the leveling agent is BYK-361N.

In yet another exemplary embodiment, the composition further includes CGE, acetone, diacetone alcohol, butan-1-ol and TZ-550. In a further exemplary embodiment, the compositions of epoxy E-51, BYK-361N, CGE, acetone, diacetone alcohol, butan-1-ol and TZ-550 are listed in Tables 2A and 28.

In another aspect of this invention, a composition for electroless plating of silver on object is provided, which includes a silver nitrate based solution and a glucose based solution.

In one exemplary embodiment, the silver nitrate based solution includes DI water (i.e. deionized water), sodium hydroxide and 28% aqueous ammonia; the glucose based solution includes citric acid, ethanol and DI water.

In a further exemplary embodiment, the compositions of the silver nitrate based solution and the glucose based solution are listed in Table 3.

In another aspect of the invention, a composition for producing an anti-scratch coating on an object is provided, which includes a saline-based coupling agent.

In one exemplary embodiment, the saline-based coupling agent is 3-mercaptopropyltrimethoxysilane. In another exemplary embodiment, the composition further includes MTMS, butan-1-ol, acetic acid, DI water, 3% colloidal silica, diacetone alcohol. In yet another exemplary embodiment, the composition further includes crystal violet. In a further exemplary embodiment, the weight percentages of the components of the composition are listed in Tables 4A and 4B.

In another aspect of the invention, a kit for electroless plating an object is provided, which includes an adhesive for generating an adhesive coating; a smoothening solution having an epoxy for smoothening the surface of an object; an electroless plating solution having a silver nitrate based solution and a glucose based solution; and an anti-scratch solution having a silane-based coupling agent for generating an anti-scratch coating.

In one exemplary embodiment, the adhesive includes epoxy E-51, BYK-361N, ethanol, acetone and TZ-550. In another exemplary embodiment, the weight percentages of the components of the adhesive are listed in Tables 1A and 1B. In yet another exemplary embodiment, the substrate is plastic, metal, or any material that reacts with silane.

In a further exemplary embodiment, the epoxy is epoxy E-51; the smoothening solution further includes BYK-361N, CGE, acetone, diacetone alcohol, butan-1-ol and TZ-550. In another exemplary embodiment, the weight percentages of the components of the smoothening solution are listed in Table 2A and 2B.

In yet a further exemplary embodiment, the electroless plating solution includes a silver nitrate based solution and a glucose based solution. In another exemplary embodiment, the silver nitrate based solution includes DI water, sodium hydroxide, and 28% aqueous ammonia; the glucose based solution includes citric acid, ethanol and DI water. In yet another exemplary embodiment, the compositions of the silver nitrate based solution and the glucose, based solution are listed in Table 3.

In another exemplary embodiment, the share-based coupling agent is 3-mercaptopropyltrimethoxysilane; the anti-scratch solution further includes MTMS, butan-1-ol, acetic add, DI water, 3% colloidal silica, diacetone alcohol and crystal violet. In yet another exemplary embodiment, the weight percentages of the components of the anti-scratch solution are listed in Table 4A and 4B.

BRIEF DESCRIPTION OF FIGURES

FIGS. 8A, 8B and 8C show the result of the RoHS directive test on a sample according to the same embodiment of this invention.

DETAILED DESCRIPTION OF CERTAIN EMBODIMENTS OF THE INVENTION

Figure 1:
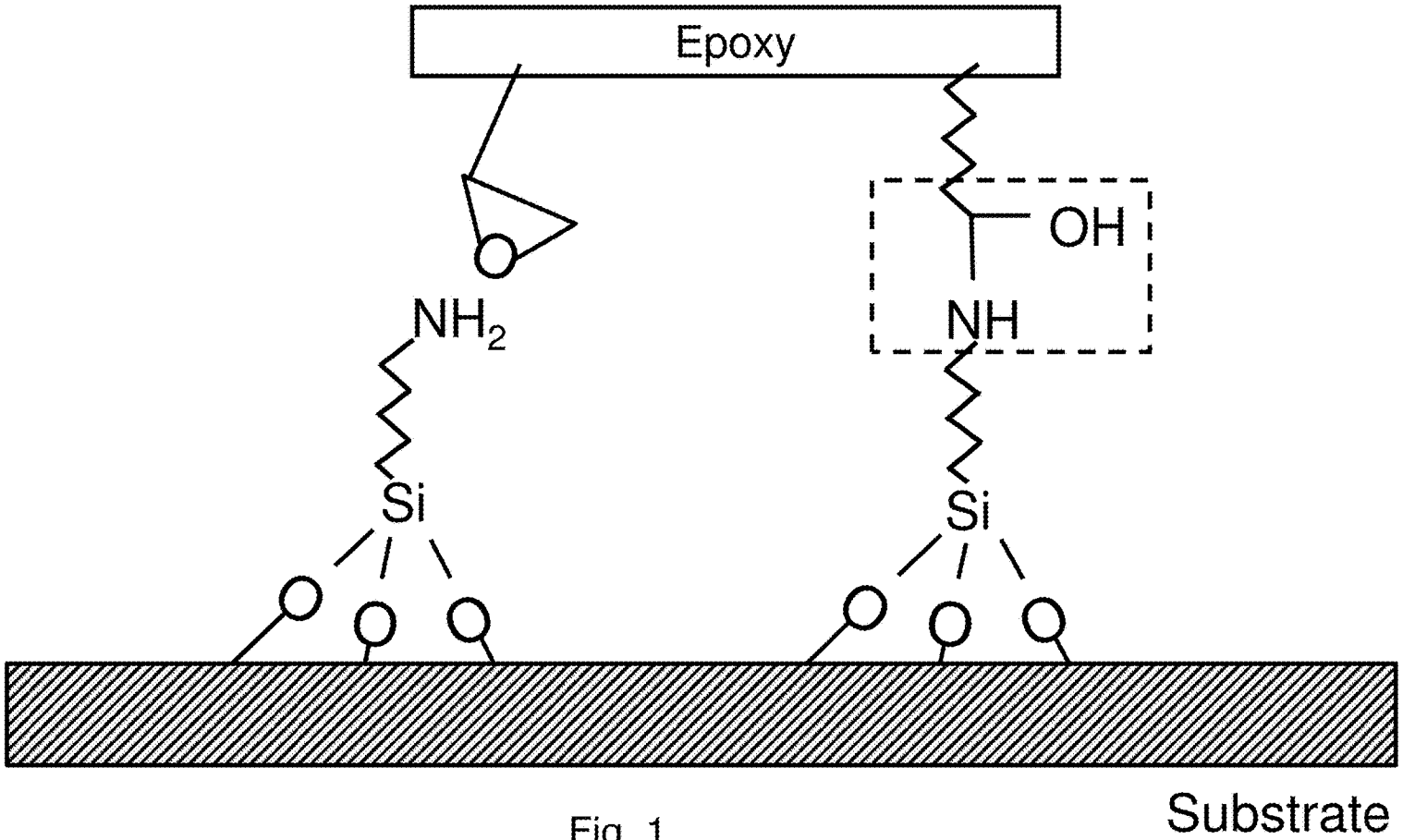
FIG. 1 shows the interaction between A1100 and the epoxy-based adhesion primer according to one embodiment of this invention.

The process of the present invention is a method of providing multiple layers of coatings to display a mirror-like performance, together with functions of anti-corrosion and anti-scratch. Detailed exemplary procedures for carrying out such method, including the preparation of coating mixtures and the coating of such mixtures on substrates, are described below in the Examples.

Suitable substrates for use in the present invention include, but are not limited to, metal substrates (e.g., steel, zinc alloys). Prior to application of the base coating, one or more initial preparation steps such as surface polishing, surface cleaning and/or surface pretreatment may be carried out. For example, the substrate surface may be polished using an abrasive method such the use of abrasive paper, vibrating grinder or drum grinder. The substrate surface may also be cleaned by contacting the surface with an aqueous surfactant solution while sonicating (i.e., exposing the surface to ultrasound for a period of time, e.g., at least 30 minutes), rinsing the surface with water, contacting the rinsed surface with a volatile organic solvent or mixture of volatile organic solvents (e.g., a mixture of acetone and ethanol) while sonicating (subjecting to ultrasound), rinsing the surface with additional volatile organic solvent, and drying. If so desired, the substrate may be subjected to a pretreatment wherein the surface is contacted with a silane such as gamma-aminopropyl triethoxysilane. The silane or mixture of silanes may be provided in the form of a solution (e.g., a solution in aqueous ethanol). The substrate may be ultrasonicated for a period of time (e.g., at least 10 minutes) while in contact with the silane. The silane-treated surface may then be dried (e.g., in an oven at 110° C. for more than 20 minutes), then cooled to room temperature.

Following any initial preparation steps as described above, an epoxy base coating is formed on the substrate surface. Typically, an epoxy resin is utilized to form the base coating on the substrate surface, wherein the epoxy resin is cured using a solidifier to provide, a base coating comprised of cured epoxy.

Any of the epoxy resins known in the art may be utilized in the present invention. Epoxy resins are characterized by the presence of two or more three-membered cyclic ether groups (epoxy groups) per molecule. Particularly useful are diglycidyl ethers of bisphenol A, derived from bisphenol A and epichlorohydrin. Other suitable epoxy resins may include epoxy cresol novolac resins and polynuclear phenol-glycidyl ether-derived resins. Reactive diluents containing a single epoxy group per molecule, such as glycidyl 2-methylphenyl ether, may be used in combination with the epoxy resin if so desired. Any of the known solidifiers (curing agents) for epoxy resins may be employed, including both catalytic curing agents and coreactive curing agents.

Examples of catalytic curing agents include Lewis acid catalysts (e.g., complexes of boron trifluoride with amines or ethers and boron trichloride complexes) and Lewsis base catalysts (e.g., tertiary amines or polyamines converted into tertiary amines upon reaction with epoxide groups). Core-active curing agents generally contain active hydrogen atoms and include, but are not limited to, polyamines (which may contain aliphatic, aromatic, cycloaliphatic and/or heterocyclic groups, for example), polyaminoamides, polyphenols, polymeric thiols, polycarboxylic acids, and anhydrides.

One or more leveling agents may be used in the base coating composition. Suitable leveling agents include, for example, polyacrylates and silicone-acrylates. The base coating composition may also contain an air release additive (defoaming agent) such as BYK-A530 silicone polymer air release additive and/or a silane coupling agent.

One or more organic solvents may be utilized in the base coating composition as well to serve as a vehicle for the other components. That is, the epoxy resin, solidifier, leveling agent and so forth may be dissolved in an organic solvent or mixture of organic solvents such as alcohols and ketones (e.g., C1-C6 aliphatic alcohols and C3-C6 aliphatic ketones such as acetone, ethanol, butanol, 4-hydroxy-4-methyl-2-pentanone). Preferably, the solvent is relatively volatile (e.g., normal boiling point not more than 100° C.) to facilitate its removal from the base coating composition once the base coating composition has been applied to the substrate surface.

In one embodiment of the invention, the base coating is formed as two layers (a lower layer and an upper layer). The lower layer may be first formed on the substrate surface by applying a lower layer composition comprised of leveling agent, solidifier and solvent (e.g., a ketone and/or alcohol). Before applying to the substrate surface, the lower layer composition may be degassed, by ultrasonication for example. Any suitable coating method may be used, such as brushing, dipping or spraying. The applied coating may then be heated under conditions effective to remove solvent (e.g., 50° C. for at least 6 hours) and provide a dried lower layer. An upper layer composition is then applied to the dried lower layer, using any of the same coating techniques. The upper layer composition may be comprised of epoxy resin, solidifier, leveling agent, reactive diluent and solvent (e.g., alcohol and/or ketone) and may be degassed by ultrasonication prior to application. Following application of the upper layer composition, the coated substrate may again be heated (e.g. 80° C. for at least 4 hours), under conditions effective to both remove solvent and induce curing of the epoxy resin by reaction with the solidifier.

A decorative mirror-like coating is then formed on the base coating by the following procedures. The surface of the base coating may be first cleaned or roughened by contacting the surface with an organic solvent or mixture of organic solvents (e.g., C1-C6 alcohols, C3-C6 ketones, in particular an acetone/ethanol mixture) and then water, suitably by rinsing. The cleaned substrates may then be dried under conditions effective to remove residual volatiles (e.g., in an oven at 90° C., with the substrate thereafter being cooled to room temperature before the next step). A sensitization step to further prepare the coated substrate for application of the mirror-like coating may then be carried out by contacting the base coating surface with an acidic solution containing stannous ions (prepared, for example, by dissolving stannous chloride into aqueous HCl). The coated substrate may, for example, be dipped into the acidic solution, rinsed with water, and then dried (e.g., in an oven at 90° C.).

The decorative mirror-like coating results from the reaction of a soluble amine complex of silver such as [Ag(NH.sub.3).sub.2].sup.+, a reducing sugar such as glucose, and an acetylenic compound such as butynediol. As a result of such reaction, the silver complex is converted, at least in part, to metallic silver, which plates onto the substrate surface. The decorative mirror-like coating thus formed is comprised of silver. A solution of the soluble silver complex may be prepared, for example, by dissolving a silver salt such as silver nitrate into water, adding caustic such as sodium hydroxide to form a precipitate, and then adding an amount of ammonium hydroxide effective to dissolve the precipitate (the resulting solution will contain [Ag(NH.sub.3).sub.2].sup.+). This solution may then be combined with a solution of reducing sugar (e.g., glucose) which also contains an acidic catalyst such as a carboxylic acid (e.g., citric acid, lactic acid) and a solution of the acetylenic compound (e.g., butynediol). The acetylenic compound solution may be first combined with the sugar solution and the resulting solution then combined with the silver amine complex solution to provide a mirror-like coating composition. The mirror-like coating composition is contacted with the coated substrate by, for example, immersing the coated substrate in the mirror-like coating composition, preferably immediately after such composition has been prepared. Contacting is typically continued for 5 to 10 minutes at approximately room temperature or such other conditions effective to form the desired mirror-like coating on the substrate, generally without stirring or vibration. Thereafter, the substrate may be rinsed with water and dried. If so desired, the mirror-like coating layer may be treated to improve its oxidation resistance by, for example, contacting the mirror-like coating layer with a solution of a thiol such as hexadecanethiol and a surfactant such as an ethoxylated nonylphenol (typically, at 30-50° C. for 1-10 minutes). Thereafter, the substrate may be rinsed with water and dried.

Following the formation of the mirror-like coating layer, a surface coating is formed on such layer to protect the mirror-like coating layer (e.g., from oxidation and scratching). Such surface coating may suitably be based on organic silicon-containing compounds such as silanes and organosilicates. Thus, the protective surface coating may be comprised of polysilicone (i.e., a composition comprised of silicon and oxygen). Organic silicon-containing compounds may be reacted, by hydrolysis and/or condensation reactions for example, to provide the protective coating. Illustrative, organic silicon-containing compounds include, for example, silanes, tetraalkyl silicates such as tetraethylsilicate, and alkylalkoxysilanes such as methyltrimethoxysilane. An illustrative example of a suitable silane is 3-glycidoxypropyltrimethoxysilane although other epoxyfunctional silanes as well as other organosilanes having alkoxy substituents and/or substituents with functional groups other than epoxy groups may also be used. The organic silicon-containing compounds may be admixed, combined with water or other liquid medium such as an alcohol, and treated with an acid such as a carboxylic acid (e.g., acetic acid) to provide a surface coating composition. If desired or needed to adjust the appearance of the final coated substrate, a dye (in particular, a violet dye such as tri(4-(dimethylamino)phenyl) methylinium chloride) is also present in the surface coating composition. The substrate having the mirror-like coating thereon is contacted (by immersion, for example) with the surface coating composition for at least one minute, then subsequently heated (e.g., at 100° C. for more than 18 hours) to yield the coated substrate in accordance with the invention.

EXAMPLES

1. Preparation of Coating Mixtures and Coating Layer with Anti-Corrosive Function.

1) Preparation of pretreatment mixture; Mix Silquest® A1100 (.gamma.-aminopropyl triethoxysilane, product of Crompton) with DI water and ethanol. Stir for more than 10 minutes to obtain a uniform solution.

2) Preparation of base coating mixture with anti-corrosive function:

(1) Lower layer mixture: The mixture used to prepare the lower layer of the base coating includes a group A component and a group B component. The group A component is obtained by mixing acetone, ethanol and BYK-361N leveling agent (product of Byk). The group B component is composed of ethanol and TZ-550 solidifier (a cycloamine curing agent, supplied by Tzar Industrial Co., Ltd. in China).

(2) Upper layer mixture: The mixture used to prepare the upper layer of the base coating also includes a group A component and a group B component. The group A component includes butan-1-ol, 4-hydroxy-4-methyl-2-pentanone, acetone, CGE (glycidyl 2-methylphenyl ether), BYK-361N leveling agent and E-51 epoxy (liquid reaction product of epichlorohydrin and bisphenol-A; epoxide eq. ca. 190 g/eq). The ingredients are added in sequence and stirred until a uniform mixture is obtained. The group B component is the solidifier (curing agent) TZ-550.

3) Fabrication of the coating layer with anti-corrosive function (base coating).

(1) Surface polishing of substrates: Steel Q195-A or zinc alloy #3 substrates are polished with abrasive papers of #240, #360 and #800, respectively; a vibrating grinder or drum grinder can also be used to polish the same substrates using suitable, grinding stones.

(2) Substrate cleaning: The polished substrates are immersed in a mixture of DI water and cleanser essence. The substrates are sonicated for more than 30 minutes. The samples are rinsed one by one using running DI water. The substrates are cleaned in 1:1 (vol.) acetone and ethanol by ultrasonication again for more than 30 minutes. The substrates are rinsed with running ethanol and then dried in air.

(3) Substrate pre-treatment: The cleaned and dried substrates are immersed in the pretreatment mixture, while ultrasonicating for more than 10 minutes. The samples are oven-dried at 110° C. for more than 20 minutes, and then cooled down to room temperature.

(4) Base coating lower layer mixture: The group A and group B components of the base coating lower layer are mixed by stirring vigorously. The mixture is degassed by ultrasonication for more than 5 minutes. The base coating lower layer mixture is coated by brushing, dipping or spraying on substrates pre-treated as described in step (3). The coated samples are then heated at 50° C. for more than 6 hours.

(5) Base coating upper layer mixture: The group A and group B components of the base coating upper layer are mixed by stirring vigorously. The mixture is degassed by ultrasonication for more than 10 minutes. The base coating upper layer mixture is coated onto the base coating lower layer by brush, dipping or spraying on substrates coated in step (3). The samples are heated at 80° C. for more than 4 hours.

2. Preparation of Mirror-Like Coating Solutions and Coating Layer with Metal Decorative Function and Gloss:

1) Preparation of roughening solution: Mix acetone and ethanol at a volume ratio of 1:1 at room temperature. Store the roughening solution in a bottle with a lid.

2) Preparation of sensitizing solution: Add stannous chloride into concentrated hydrochloric acid (36%) at room temperature until the stannous chloride is dissolved. Add DI water to make the concentrations of stannous chloride and hydrochloric acid in the solution 5 g/L and 5 g/L, respectively.

3) Preparation of mirror-like coating solutions: Mirror-like coating solutions include solution A, B and C, in which:

(1) Solution A is prepared as follows to get a solution of $[Ag(NH_3)_2]^+$ with a concentration of 10 g/L: Dissolve silver nitrate into DI water. Dissolve sodium hydroxide into a small amount of DI water, and add the solution of sodium hydroxide into the above-mentioned silver nitrate solution while stirring vigorously, to get khaki-colored precipitation. Add a suitable amount of 10% of ammonium hydroxide into above mixture until the precipitation is dissolved. Add DI water into the solution until the concentration of $[Ag(NH_3)_2]^+$ in the solution is 10 g/L.

(2) Solution B is a solution of glucose in water and ethanol. Mix ethanol and DI water to provide a mixed solvent. Dissolve glucose and citric acid into the aforementioned mixed solvent. Add DI water to make the concentration of glucose in the solution 8 g/L.

(3) Solution C is a butynediol solution in DI water with a concentration of 8.6 g/L.

4) Preparation of anti-oxidant solution for mirror-like coating layer: The use of this solution is optional. Dissolve 1-hexadecanethiol into iso-propanol. Stir until the solution is uniform (solution A). Add surfactant of polyoxyethylene (9) nonylphenyl ether (IGEPAL CO-630) into DI water to provide solution B. Mix solution A and B to obtain a uniform solution.

5) Fabrication of mirror-like coating layer.

(1) Sample cleaning: Rinse the substrates coated with anti-corrosive base coating as described previously with running 1:1 (vol.) of acetone and ethanol, and then DI water, respectively. Dry the samples in oven at 90° C. Cool down the samples to room temperature in air.

(2) Sensitization of samples: Dip the cleaned and dried substrates coated with anti-corrosive coating into stannous chloride solution, and then rinse the samples with running DI water. Dry the samples in oven at 90° C., and then cool down to room temperature.

(3) Fabrication of mirror-like coating: solution A and B used to obtain the mirror-like coating will be mixed at a volume ratio of A:B=1:1 to 1:2. The reaction will be faster for ratio of A:B=1:2. At first, mix solution B and C while stirring, in which solution C is 5% of the total volume of A and B. Solution A is then added into above solution of B and C. Immerse substrates pre-treated by roughening and sensitizing steps at room temperature (ca. 20-25° C.) into above mixture solution immediately for ca. 4-6 min. The reaction is carried out without stirring or vibration, and a shiny mirror-like coating will be formed on the surface of the samples. Rinse the samples with DI water more than 3 times, and dry at room temperature.

(4) Anti-oxidation treatment of mirror-like coating layer (optional step): Immerse the samples with the mirror-like coating layer deposited thereon into the anti-oxidation solution at 40° C. for 5 min. Rinse the sample with DI water for more than 3 times, and dry at room temperature.

3. Preparation of Surface Coating Mixtures with Anti-Scratch Function and Coating Layer.

1) Mix silanes of 3-glycidoxypropyltrimethoxysilane (A187), tetraethylsilicate (TEOS) and methyltrimethoxysilane (MTMS) at room temperature. Sonicate the mixture in an ultrasonic bath for 3 minutes. Add DI water into the above silane mixture at room temperature, and then sonicate for 3 minutes. Add acetic acid into the solution at room temperature, and treat at room temperature for more than 12 minutes. Butan-l-ol is added to dilute the coating product.

2) Violet dye of tris(4-(dimethylamino)phenyl)methylium chloride is added into above anti-scratch coating mixture to adjust the appearance of the coated sample if necessary.

3) Fabrication of the coating layer with anti-scratch function. Immerse the samples coated with the mirror-like coating layer in above anti-scratch coating mixture for more than 1 minute. Heat the samples at 100° C. for more than 18 hours.

4. An Object with Multiple Coatings Fabricated by Electroless Coating

This exemplary embodiment of the instant invention describes an object with multiple coatings by electroless plating (i.e. without the use of electroplating). The fabrication process thereof, the advantages brought along by each of the coatings and the test results of the coated object are also described.

The overall electroless coating method of this invention involves three main steps, namely: the base coating application step, the silver coating application step and the anti-scratch coating application step. The procedure and materials used in each of these steps are discussed below.

4.1 Base Coating Application Step

First of all, before the base coating is applied on the object, which is a metal substrate in this exemplary embodiment, a preparation step of surface polishing, surface cleaning and/or surface pre-treatment as afore-described can be optionally carried out on the substrate.

4.1.1 Surface Pre-Treatment

In one specific embodiment, the object was pre-treated with a pre-treatment solution prepared by mixing 8.64 g A1100 with 750 mL ethanol and 31.52 g DI water at room temperature for 10 minutes. The object was first in contact with the pre-treatment solution and sonicated at room temperature for 10 minutes. Then, the object was dried in an oven at 100° C. for 20 minutes and cooled to room temperature to obtain the pre-treated object.

4.1.2 Compositions of the Adhesion Coating Solution and the Smoothening Coating Solution The base coating includes two primer coating: an adhesion coating and a smoothening coating. The adhesion coating is first applied on the substrate surface for enhancing adhesion of the base coating to the substrate and providing anti-corrosion property to the coated object. The smoothening coating is then applied on the adhesion coating for improving the smoothness of the base coating so as to enhance the adhesion of the base coating to the silver coating.

The range of compositions of the adhesion coating solution and the smoothening coating solution are listed in Tables 1A and 2A respectively.

TABLE 1A

| Range of composition of the adhesion coating solution | |
|---|---|
| Component | Range of weight % |
| Epoxy E-51 | 28.99%-32.04% |
| BYK-361N | 0.23%-0.26% |
| Ethanol | 6.96%-7.69% |

TABLE 1A-continued

| Range of composition of the adhesion coating solution | |
|---|---|
| Component | Range of weight % |
| Acetone | 54.46%-60.19% |
| TZ-550 | 4.36%-4.81% |

TABLE 2A

| Range of composition of the smoothening coating solution | |
|---|---|
| Component | Range of weight % |
| Epoxy E-51 | 41.96%-46.38% |
| BYK-361N | 0.22%-0.57% |
| CGE | 5.77%-5.82% |
| Acetone | 4.39%-4.93% |
| Diacetone alcohol | 23.82%-26.15% |
| Butan-1-ol | 9.37%-15.61% |
| TZ-550 | 6.56%-8.44% |

In a specific embodiment, the compositions of the adhesion coating solution and the smoothening coating solution are listed in Tables 1B and 2B respectively.

TABLE 1B

| Composition of the adhesion coating solution | |
|---|---|
| Component | Weight % |
| Epoxy E-51 | 30.52% |
| BYK-361N | 0.24% |
| Ethanol | 7.33% |
| Acetone | 57.33% |
| TZ-550 | 4.58% |

TABLE 2B

| Composition of the smoothening coating solution | |
|---|---|
| Component | Weight % |
| Epoxy E-51 | 44.17% |
| BYK-361N | 0.40% |
| CGE | 5.80% |
| Acetone | 4.66% |
| Diacetone alcohol | 24.98% |
| Butan-1-ol | 12.49% |
| TZ-550 | 7.50% |

In one embodiment, acetone in the adhesion coating mixture or the smoothening coating mixture acts as solvent and can be added up to 90% of the total volume of the adhesion coating mixture, or the smoothening coating mixture.

Besides, the different weight percentages of the solvent (i.e. acetone) in adhesion coating mixture and the smoothening coating mixture will lead to different evaporation rates of these two coating mixtures.

4.1.2.1 Preparation of the Adhesion Coating Solution

In one specific embodiment, the adhesion coating solution includes an adhesion primer solution and a solidifier solution. Firstly, the adhesion primer solution (1 kg) was prepared by mixing 713.05 g epoxy E-51 with 171.15 g acetone and 115.8 g ethanol at room temperature until a uniform solution was formed. The solidifier solution (1 kg) was prepared by mixing 33.90 g BYK-361N with 636.80 g TZ-550 and 329.30 g ethanol at room temperature until a uniform solution was formed.

Then, 342.4 g adhesion primer solution was mixed with 400.0 g acetone and 57.6 g solidifier solution at room temperature for 3 min, followed by ultrasonication in water bath for 10 minutes to obtain the adhesion coating solution.

4.1.2.2 Preparation of the Smoothening Coating Solution

In one specific embodiment, the smoothening coating solution includes a smoothening primer solution and TZ-550. Firstly, the smoothening primer solution (1 kg) was prepared by mixing 477.55 g epoxy E-51 with 135.05 g butan-1-ol, 270.10 g diacetone alcohol, 50.35 g acetone, 62.65 g CGE and 4.30 g BYK-361N at room temperature until a uniform solution was formed.

Then, 925.0 g smoothening primer solution was mixed with 75.0 g TZ-550 at room temperature for 3 min, followed by ultrasonication in water bath for 10 minutes to obtain the adhesion coating solution to obtain the smoothening coating solution.

4.1.3 Coupling Agent A1100

In applying the adhesion coating onto the substrate, coupling agent A1100 is added to enhance the adhesion of the epoxy-based adhesion coating to the surface of the substrate. The enhanced adhesion is made possible by the interaction between the NH group of A1100 and the O group of the epoxy, resulting in a strong bonding between these two functional groups, as shown in FIG. 1.

4.1.4 Application of the Adhesion Coating onto Object

The adhesion coating solution prepared as described above was first degassed by ultrasonication for more than 5 minutes. The adhesion coating mixture was coated by brushing, dipping or spraying on the object. The coated object was then cured at 150° C. for 15 minutes.

In one specific embodiment, the adhesion coating solution was sprayed onto the object as follows. Firstly, DI water was sprayed onto the object at 22 mL/min and 3 bar. Then, acetone was sprayed onto the object, followed by spraying the adhesion coating solution onto the object for 30 seconds with the spray gun being held at around 15 cm away from the object. The coated object was cured at 150° C. for 15 minutes.

4.1.5 Application of the Smoothening Coating onto Object Coated with the Adhesion Coating The smoothening coating solution prepared as described above was first degassed by ultrasonication for more than 10 minutes. The smoothening coating mixture was then applied onto the adhesion coating by brushing, dipping or spraying. The coated substrate was then heated at cured at 80° C. for 3 to 6 hours.

In one specific embodiment, the smoothening coating solution was sprayed onto the object as follows. Firstly, DI water was sprayed onto the object at 55 mL/min and 3 bar. Then, acetone was sprayed onto the object, followed by spraying the smoothening coating solution onto the object for 30 seconds with the spray gun being held at around 15 cm away from the object. The coated substrate was then heated at cured at 80° C. for 3 to 6 hours.

4.2 Silver Coating Application Step

In this step, silver is electroless plated onto the base coating by redox reaction in which silver amine complex $[Ag(NH_3)_2]^+$ reacts with glucose that acts as a reducing sugar.

4.2.1 Compositions of the Electroless Plating Solution

The electroless plating solution includes two solutions, a silver nitrate based solution and a glucose based solution, and the range of compositions thereof are listed in Table 3.

TABLE 3

Composition of silver nitrate based solution and a glucose based solution and glucose based solution

| Chemical | Composition |
|---|---|
| Silver nitrate based solution | |
| DI water | 980 mL |
| Sodium hydroxide | 6.00 g |
| Silver nitrate | 10.00 g |
| 28% aqueous ammonia | 20 mL |
| Glucose based solution | |
| Glucose | 8.00 g |
| Citric acid | 0.54 g |
| Ethanol | 20 mL |
| DI water | 980 mL |

In one exemplary embodiment, the concentration of silver nitrate in the silver nitrate based solution is in the range of 7.5-20 g/L. In another exemplary embodiment, the concentration of glucose in the glucose based solution is in the range of 5-20 g/L.

4.2.1.1 Preparation of the Silver Nitrate Based Solution

In one specific embodiment, the silver nitrate based solution was prepared as follows. 6.00 g sodium hydroxide was mixed with 20 mL DI water at room temperature until all solids were dissolved to obtain sodium hydroxide solution. Then, 10 g silver nitrate and 100 mL DI water were added to the mixture at room temperature until all solids were dissolved to obtain silver nitrate solution. The sodium hydroxide solution was then added to the silver nitrate solution until brown precipitates were formed. 30 mL 28% aqueous ammonia was mixed with 60 mL DI water to obtain ammonia solution. The ammonia solution was then added dropwise to the mixture of sodium hydroxide and silver nitrate until all brown precipitates were just re-dissolved to obtain a clear solution. The clear solution was finally diluted to 1 L with DI water to obtain the silver nitrate based solution.

4.2.1.2 Preparation of the Glucose Based Solution

In one specific embodiment, the glucose based solution was prepared by mixing 8.00 g glucose with 0.54 g citric add, 20 mL ethanol and 980 mL water at room temperature until a uniform solution was formed to obtain the glucose based solution.

4.2.1.3 Preparation of the Sensitization Solution

In one specific embodiment, the sensitization solution was prepared by first mixing 4.00 g $SnCl_2$ with 4 mL 37% hydrochloric add, and the mixture was heated at 60° C. for 10 minutes until a clear solution was formed. Then 800 mL DI water was added to the clear solution at room temperature to obtain the sensitization solution.

4.2.2 Application of the Silver Coating onto the Object Coated with the Base Coating 4.2.2.1 Cleaning The object coated with the base coating was rinsed with running 1:1 (by volume) of acetone and ethanol for 1 minute, followed by DI water for another minute.

The cleaning of the epoxy-based base coating not only removes unreacted epoxy residuals, but also roughens the epoxy surface to improve the mechanical inter-locking of Sn ions and silver on attaching onto the epoxy surface in the later steps.

4.2.2.2 Sensitization

In this step, the base coating surface was contacted with an acidic solution containing stannous ions by contacting the cleaned and dried substrate with stannous chloride solution.

The substrate was then rinsed with running DI water, dried in oven at 90° C. and cooled down to room temperature in air.

Stannous chloride ($SnCl_2$) was used as sensitizing agent to enhance the adhesion between silver and epoxy surface of the base coating. In one embodiment, the stannous chloride was oxidized (e.g. by air for 1 day) before being applied to substrate. It was discovered by the inventors that upon oxidation (or aging), some of the $Sn^{2+}$ ions will be oxidized into $Sn^{4+}$ ions and the resulting mixture of $Sn^{2+}$ ions and $Sn^{4+}$ ions was shown to be a better enhancer for silver/epoxy adhesion than "fresh stannous chloride" that only carries $Sn^{2+}$ ions.

In one specific embodiment, the sensitization solution was sprayed onto the object as follows. Firstly, DI water was sprayed onto the object at 10 mL/min and 3 bar. Then, the sensitization solution was sprayed onto the object for 30 seconds with the spray gun being held at around 5 cm away from the object.

4.2.2.3 Application of Silver Coating onto the Object

Upon sensitization, the silver nitrate based solution and the glucose based solution were simultaneously cross-sprayed onto the sensitized substrate for 0.5 minute at ambient temperature. With cross-spraying, particles from the silver nitrate based solution and the glucose based solution would result in a fine vapor format before hitting the surface of the sensitized substrate. As such, a uniform layer of silver nanoparticles (around 30 to 150 nm in size) can be coated onto the substrate by cross-spraying, in which the resulting product will have the same or even better shinny effect than a silver coated product by electroplating. Thereafter, the substrate was rinsed with DI water and then dried at 100° C. oven for at least 15 minutes.

In one exemplary embodiment, the feed rate of the silver nitrate based solution and the glucose based solution should be in the ratio of 3:2 to 1:3 (e.g.s, 12 ml/min:8 ml/min, 8 ml/min:8 ml/min, 8 ml/min:12 ml/min, 8 ml/min:16 ml/min, or 8 ml/min:24 ml/min etc.)

In another exemplary embodiment, the concentration of silver nitrate based solution was 10 g/L; the concentration of the glucose based solution was 8 g/L; the feed rate of the silver nitrate based solution was 10 ml/min; and the feed rate of the glucose based solution was 20 ml/min.

In yet another specific embodiment, the silver nitrate based solution and the glucose based solution were sprayed onto the object as follows. Firstly, the sensitized object was washed with DI water for 1 minute. Then, a double-headed spray gun was used in which DI water was sprayed onto the object via the first spray head at 10 mL/min, and DI water was sprayed onto the object via the second spray head at 20 mL/min, with both spray guns being held at around 40 cm away from the object. Afterwards, the silver nitrate based solution and the glucose based solution were simultaneously sprayed onto the object via the first spray head and the second spray head, respectively, for 60 seconds. The sprayed object was then washed with DI water for 1 minute, dried with compressed air for 30 seconds, cured at 100° C. for 15 minutes, and cooled to room temperature.

4.2.2.4 Anti-Oxidation Treatment

The substrate with silver coating can be optionally treated for enhanced anti-oxidation effect. In this step, the substrate was in contact with an anti-oxidation solution at 40° C. for 5 min. The substrate was then rinsed with DI water for more than 3 times and dried at room temperature.

4.2.3 Glucose as Reducing Agent

Reducing agents was conventionally known for electroless plating of silver, and some of the reducing agents include formaldehyde and invert sugar. However, as discussed in U.S. Pat. No. 4,737,188 ('188 patent), such prior art reducing agents tended to be unstable in use in which hydrogen was released and/or the reducing sugar was decomposed to form sludge or other by-products.

Further, higher temperatures are required for reducing agents such as invert sugar to develop an efficient deposit of silver. For instance the '188 patent disclosed a temperature range of 43°-54° C. and that silver deposition would be very inefficient and costly below this temperature range.

However, it was observed that the inventors have successfully utilized glucose as an effective reducing agent for depositing a uniform nano-scaled silver layer on the epoxy surface of the substrate. Further, the deposition of the silver layer (i.e. spraying process) was carried out at ambient temperature, which was much below the high temperatures taught in the '188 patent.

4.3 Anti-Scratch Coating Application Step

In this step, a silicon-containing anti-scratch coating is applied onto the silver coating to enhance the anti-scratching effect of the coated substrate.

4.3.1 Compositions of the Anti-Scratch Coating Solution

The range of compositions of the anti-scratch coating solution are listed in Table 4A.

TABLE 4A

Range of composition of the anti-scratch coating solution

| Chemical | Range of weight % |
|---|---|
| MTMS | 33.88%-35.26% |
| A189 | 3.92%-4.08% |
| Butan-1-ol | 11.80%-12.28% |
| Acetic acid | 1.18%-1.23% |
| DI water | 13.61%-13.69% |
| 3% colloidal silica | 1.18%-1.23% |
| Diacetone alcohol | 32.66%-33.99% |
| Crystal violet | 0.01%-0.02% |

In a specific embodiment, the composition of the mixture for the anti-scratch coating solution is listed in Table 4B.

TABLE 4B

Composition of the anti-scratch coating solution

| Chemical | Weight % |
|---|---|
| MTMS | 34.57% |
| A189 | 4.00% |
| Butan-1-ol | 12.04% |
| Acetic acid | 1.21% |
| DI water | 13.65% |
| 3% colloidal silica | 1.21% |
| Diacetone alcohol | 33.32% |
| Crystal violet | 0.01% |

4.3.1.1 Preparation of the Anti-Scratch Coating Solution

In one specific embodiment, the anti-scratch coating solution was prepared by first mixing 36.0 g A189 with 311.2 g MTMS, 122.9 g DI water, 10.8 g acetic acid, 108.3 g butan-1-ol and 10.8 g 3% colloidal silica at room temperature for 15 minutes. The solution was then ultrasonicated in water bath for 45 minutes, heated at 70° C. for 10 hours and cooled to room temperature. 0.11 g crystal violet and 300 g diacetone alcohol were then added to the cooled solution to obtain the anti-scratch coating solution.

4.00 g $SnCl_2$ with 4 mL 37% hydrochloric acid, and the mixture was heated at 60° C. for 10 minutes until a clear solution is formed. Then 800 mL DI water was added to the clear solution at room temperature to obtain the sensitization solution.

4.3.2 Coupling Agent A189

The chemical structure of A189, 3-mercaptopropyltrimethoxysilane, is shown in formula (I) below.

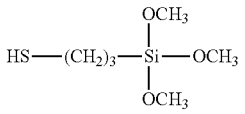

(I)

Figure 2:
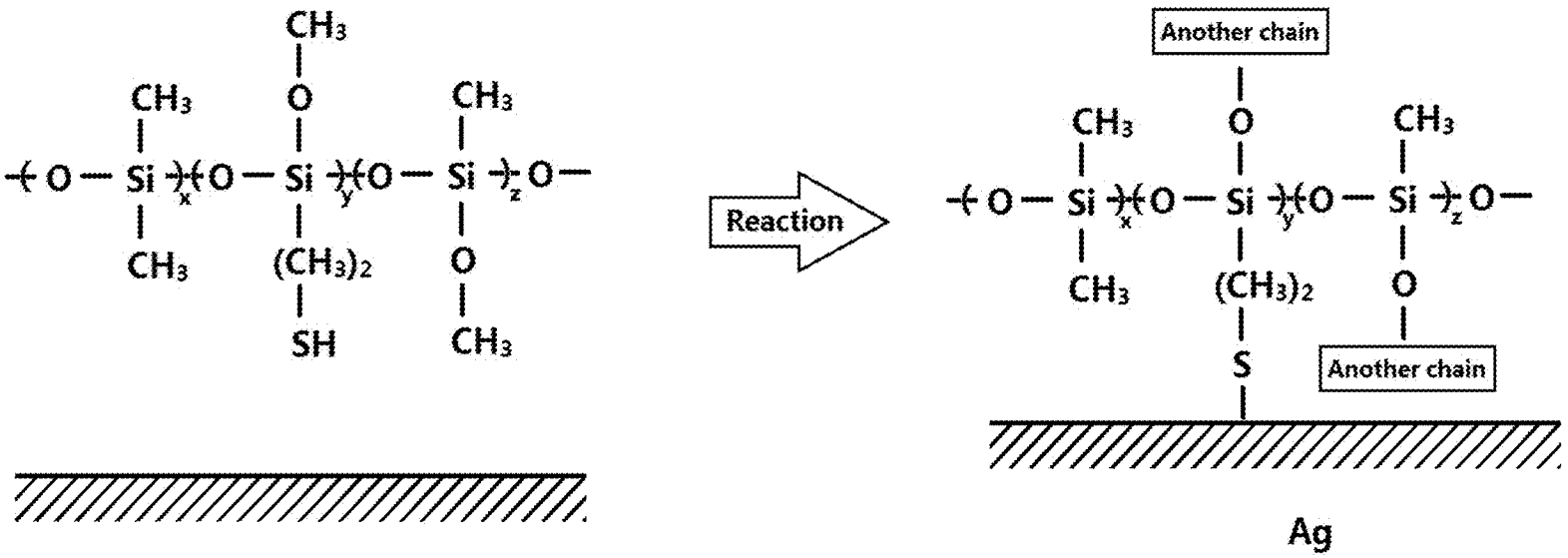
FIG. 2 shows the interaction between A189 and the silver coating according to the same embodiment of this invention.

In applying the anti-scratch coating onto the silver coating, coupling agent A189 mixed with the saline-based anti-scratch coating solution is applied to the silver coating for enhancing the adhesion of the silicon-based anti-scratch coating to the silver coating. The enhanced adhesion is made possible by the interaction between the SH group of A189 and the silver surface of the silver coating, resulting in a strong bonding therebetween, as shown in FIG. 2.

4.3.3 Crystal Violet

Crystal violet was added into the above anti-scratch coating mixture to adjust the appearance of the coated sample, if necessary. In particular, crystal violet was added to remove the yellowish side effect on the silver surface of the silver coating.

4.3.4 Application of the Anti-Scratch Coating onto the Substrate Coated with the Silver Coating Samples coated with the silver coating layer were in contact with the above anti-scratch coating mixture for more than 1 minute. The substrate was heated at 100° C. for more than 18 hours. The coated substrate was then cured at 150° C. for 3 hours to obtain the object with multiple coatings.

In one specific embodiment, the anti-scratch coating solution was sprayed onto the object as follows. Firstly, DI water was sprayed onto the object at 8 mL/min and 3 bar. Then, the anti-scratch coating solution was sprayed onto the object for 35 seconds with the spray gun being held at around 15 cm away from the object. The coated substrate was then cured at 150° C. for 3 hours.

4.4 Sample Testing

In this series of tests, decoration product fabricated by the method described in the instant Example 4 samples (hereinafter "electroless samples") were tested against silver-coated samples fabricated by electroplating method (hereinafter "electroplating samples"). The metal substrates used for electroless samples and electroplating samples are steel Q-195A and/or Zn alloy #3.

4.4.1 Decoration Test

Figure 3:
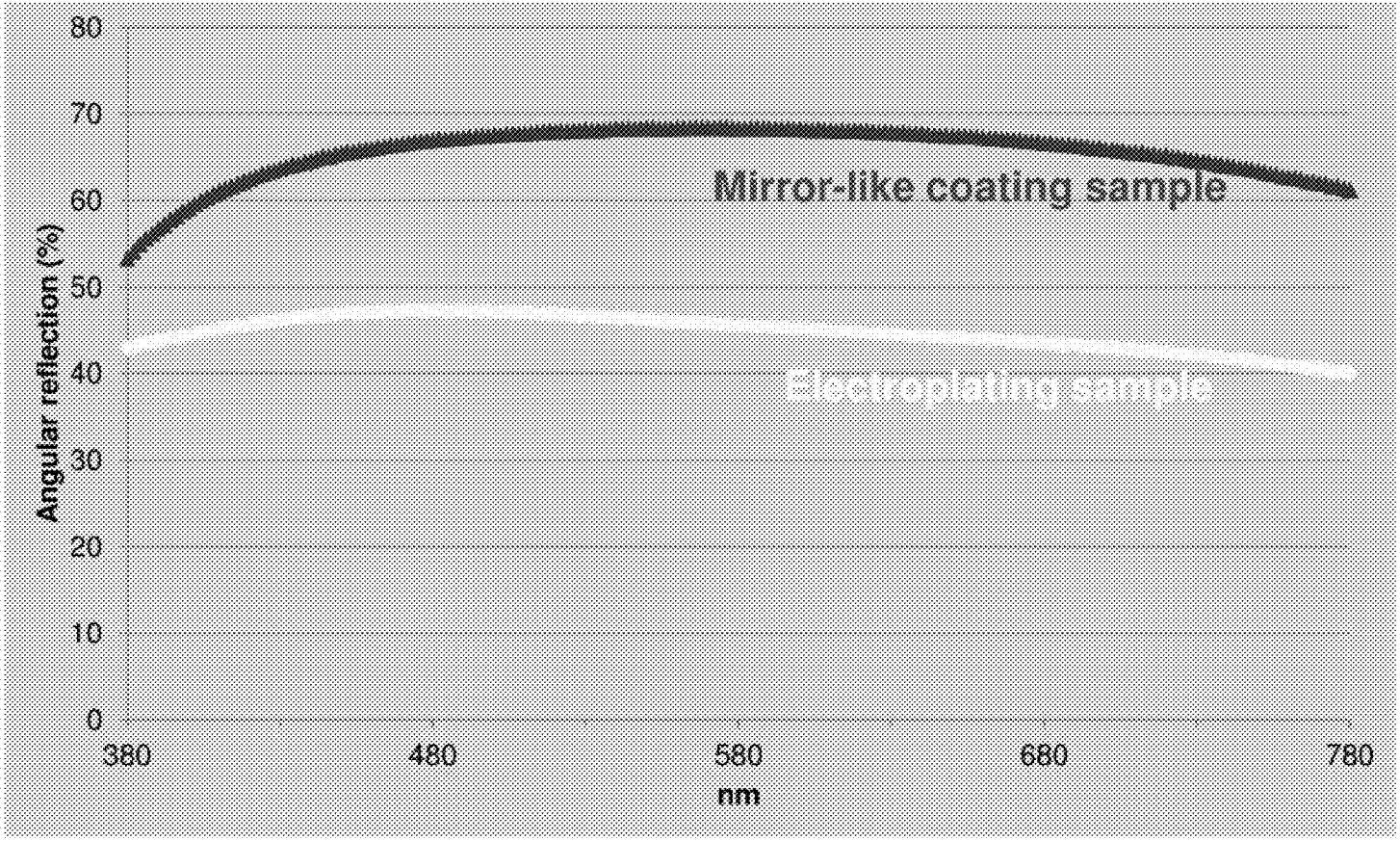
FIG. 3 shows the result of the decoration test on a sample according to the same embodiment of this invention.

Angular reflection at 45° at 380-780 nm of the electroless samples and the electroplating samples were measured using a UV-Vis spectrophotometer. As shown in FIG. 3, the electroless samples had a higher angular reflection than its counterpart. The reflection area of the electroless samples is 26,264 as compared to that of the electroplating samples of 17,911.

As a result, the electroless samples are shown to have a much better decorative effect than the electroplating samples.

4.4.2 Adhesion Test

Figure 4:
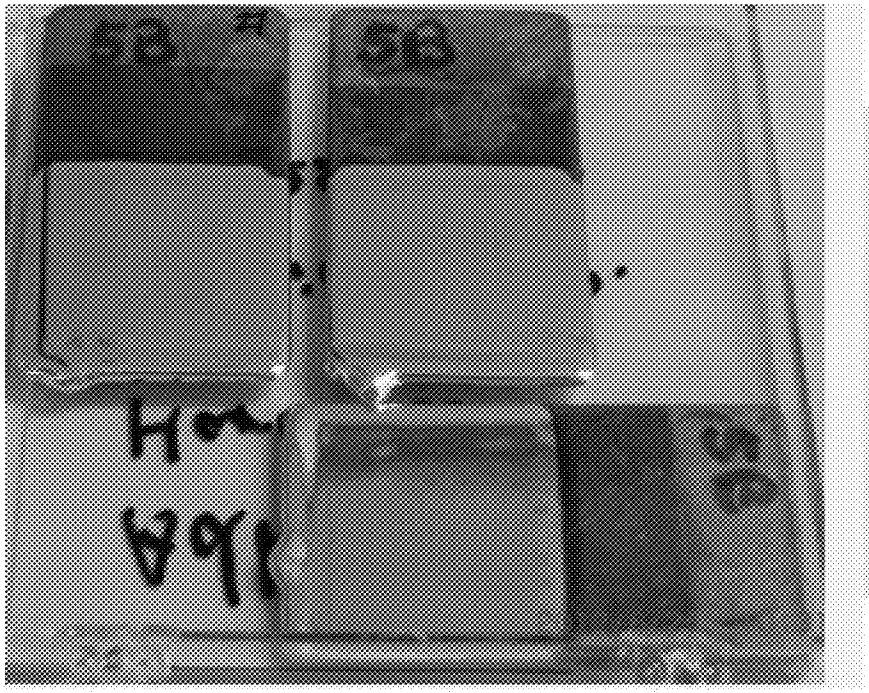
FIG. 4 shows the result of the adhesion test on a sample according to the same embodiment of this invention.

ASTM D3359-08 Standard Test Method for Measuring Adhesion by Tape Test with reference to ISO 2409:2007 Paints and varnishes was adopted in this test (cross-cut test). The result, as illustrated in FIG. 4, showed that no flakes—were detached from the electroless samples, reaching a "5B" classification (indicating that none of the tested area is detached) which was better than the requirement of "4B" classification (indicating that less than 5% of the tested area is detached)

Thus, the layers, especially the silver-coated layers, of the electroless samples were shown not to be easily detached from the electroless samples.

4.4.3 Anti-Corrosion Test

Figure 5:
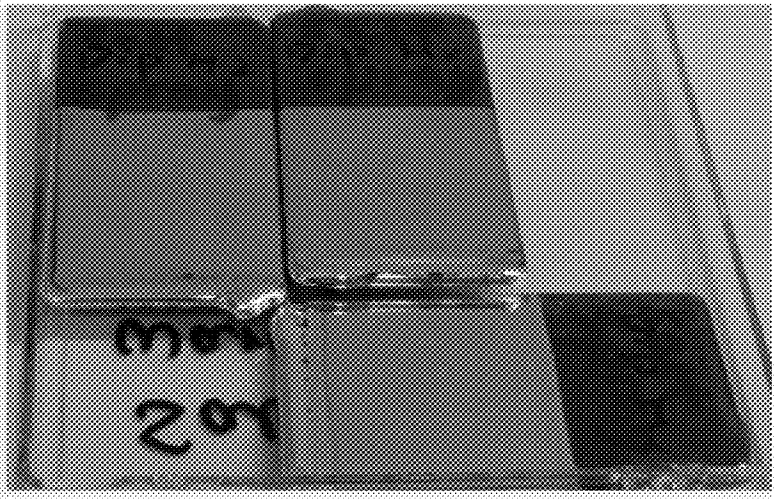
FIG. 5 shows the result of the anti-corrosion test on a sample according to the same embodiment of this invention.

ASTM B117-07 Standard Practice for Operating Salt Spray (Fog) Apparatus with reference to ISO 9227:2006 Corrosion tests in artificial atmospheres was adopted in this test (salt spray test—72 hours without corrosion). The result, as illustrated in FIG. 5, showed that there was no visible change from the electroless samples.

Thus, the electroless samples were shown to be resistant from corrosion.

4.4.4 Impact Test

Figure 6:
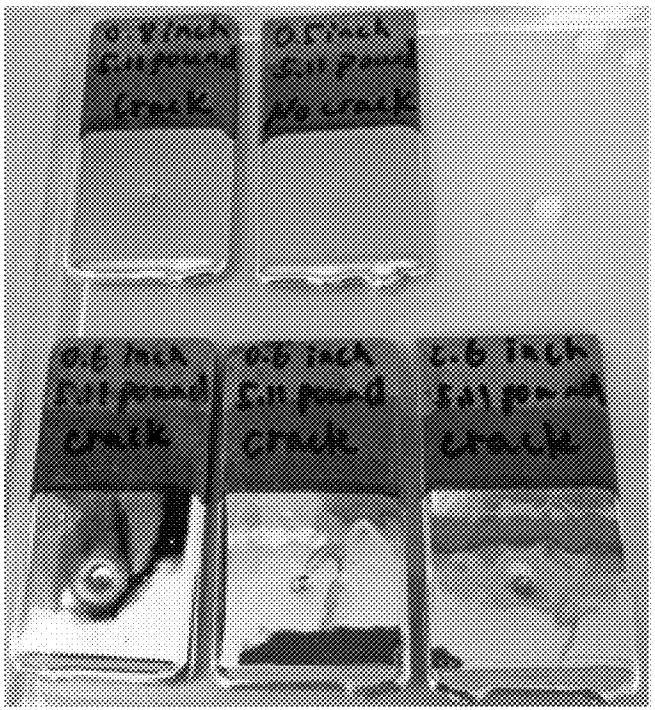
FIG. 6 shows the result of the impact test on a sample according to the same embodiment of this invention.

ASTM D2794-93(2004) Standard Test Method for Resistance of Organic Coatings to the Effects of Rapid Deformation was adopted in this test (steel ball impact—no visible crack). The result of this test, as illustrated in FIG. 6, showed that there was no visible cracks from the electroless samples.

Thus, the electroless samples were shown to be not easily be deformed.

4.4.5 Hardness Test

Figure 7:
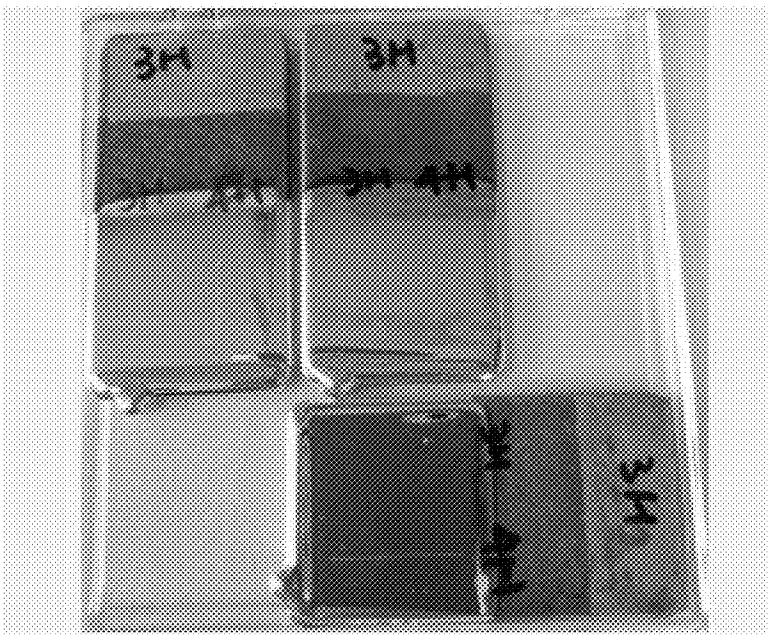
FIG. 7 shows the result of the hardness test on a sample according to the same embodiment of this invention.

ASTM D3363-05 Standard Test Method for Film Hardness by Pencil Test with reference to ISO 15184:1998 Paints and varnishes was adopted in this test (pencil test—≥2 h). The result, as illustrated in FIG. 7, showed that the electroless samples were able to sustain the test for 3 to 4 hours.

Thus, the electroless samples were shown to be resistant from scratch on the surfaces thereof.

4.4.6 RoHS Directive Test

The test was performed with reference to IEC 62321:2008 by SGS Hong Kong Ltd. The result of this test, as illustrated in FIGS. BA, 8B and 8C, showed that Cd, Pb, Hg, Cr (VI), PBBs, PBDE are not detected.

Thus, the electroless samples were shown to be environmentally friendly since no toxic heavy metals or hydrocarbons were detected.

4.4.7 UV Light Exposure Test

Figure 9:
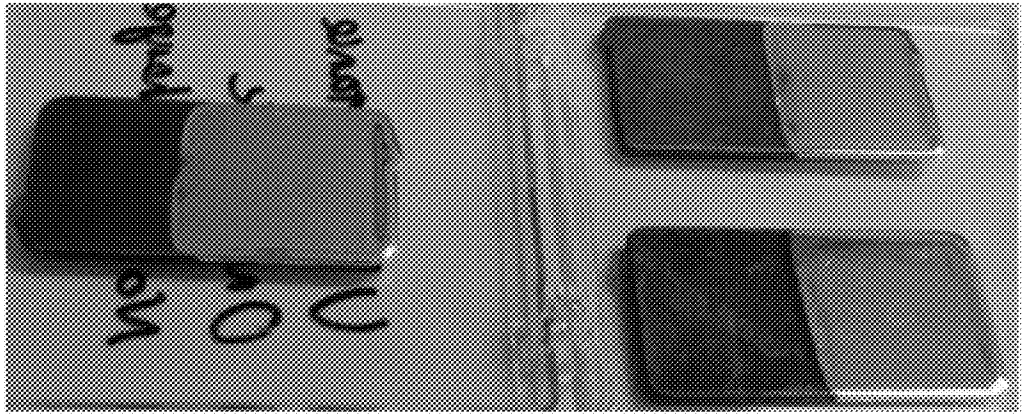
FIG. 9 shows the result of the UV light exposure test on a sample according to the same embodiment of this invention.

ASTM G154-04 Standard Practice for Operating Fluorescent Light Apparatus for UV Exposure of Nonmetallic Materials, with reference to ISO 4892-3—Exposure mode 1/2 was adopted in this test. The result, as illustrated in FIG. 9, showed that there was no visible color change from the electroless samples.

Thus, the coating of the electroless samples were shown to provide protection against UV light.

4.4.8 Water Proof Test

Figure 10:
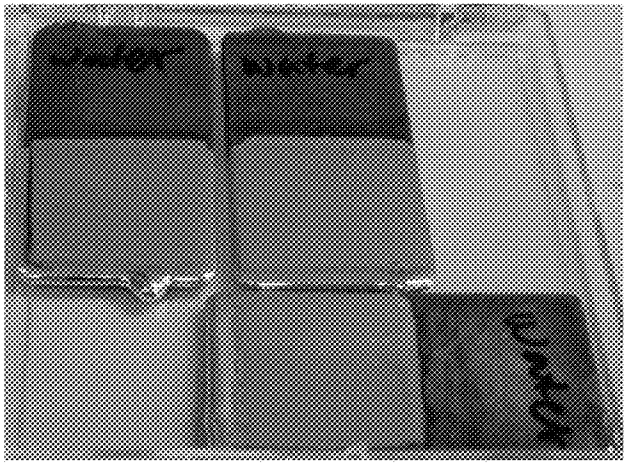
FIG. 10 shows the result of the water proof test on a sample according to the same embodiment of this invention.

In this test, the electroless samples were soaked in water at 40° C. for 24 hours. The result, as illustrated in FIG. 10, showed that there was no visible color change from the electroless samples.

Thus, the electroless samples were shown to be water resistant.

4.4.9 Acid Resistant Test

Figure 11:
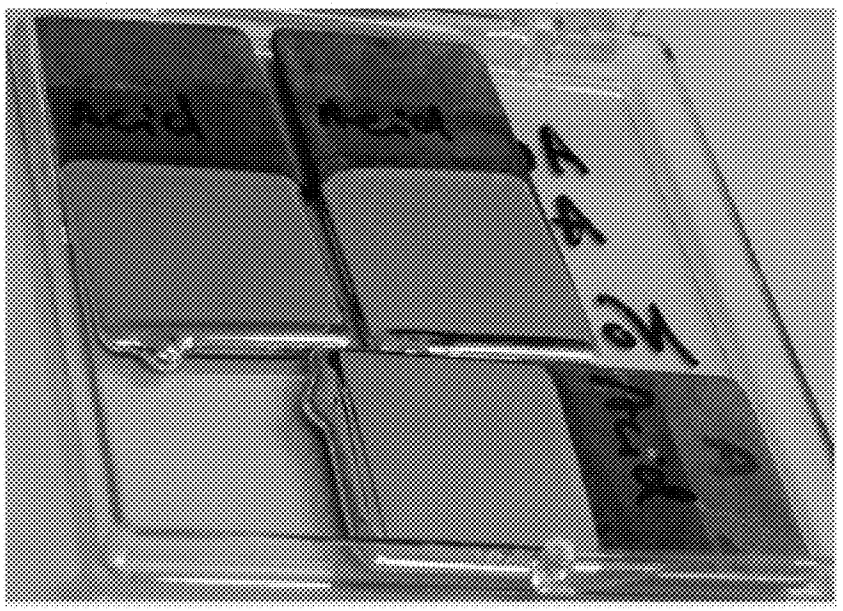
FIG. 11 shows the result of the acid resistant test on a sample according to the same embodiment of this invention.

In this test, the electroless samples were soaked in 0.1N $H_2SO_4$ at room temperature for 24 hours. The result, as illustrated in FIG. 11, showed that there was no visible color change from the electroless samples.

Thus, the electroless samples were shown to be acid resistant.

4.4.10 Alkali Resistant Test

Figure 12:
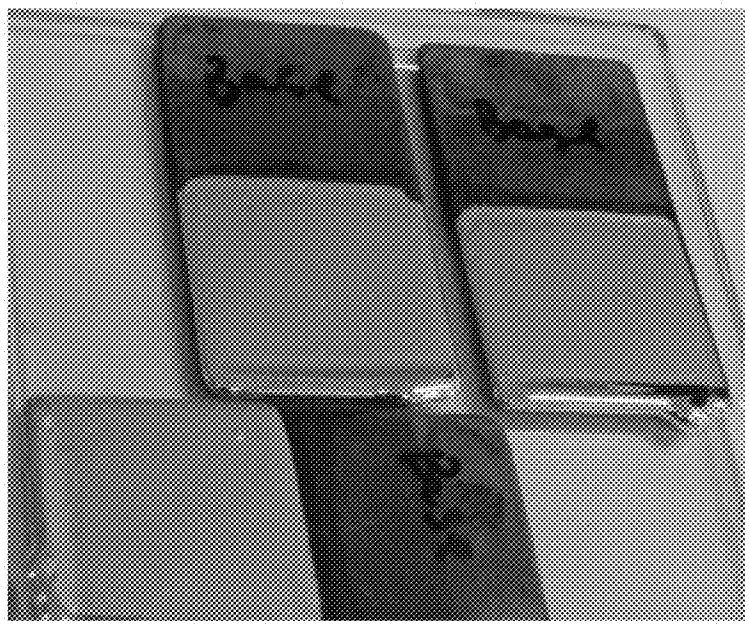
FIG. 12 shows the result of the alkali resistant test on a sample according to the same embodiment of this invention.

In this test, the electroless samples were soaked in 0.1N NaOH at room temperature for 24 hours. The result, as illustrated in FIG. 12, showed that there was no visible color change from the electroless samples.

Thus, the electroless samples were shown to be alkali resistant.

The preferred embodiments of the present invention are thus fully described. Although the description referred to particular embodiments, it will be clear to one skilled in the art that the present invention may be practiced with variation of these specific details. Hence this invention should not be construed as limited to the embodiments set forth herein.

For example, acetone is used in this invention as solvent, but it is clear that other chemicals such as methanol, benzene, triethylamine, acetic acid, chlorobenzene, phenol and quinolone can also be used.

Further, it is clear to one skilled in the art that spraying time could vary depending on factors like size of the object being sprayed, the spraying environment, etc.

What is claimed is:

1. A method of electroless plating an object, comprising:

applying, on a surface of the object, an adhesion coating solution that includes 28.99%-32.04% of Epoxy E-51, 0.23%-0.26% of polyacrylate, 6.96%-7.69% of ethanol, 54.46%-60.19% of acetone, and 4.36%-4.81% of a phenolic aldehyde amine crosslinking agent by weight, such that an adhesion coating of a base coating is formed on the surface of the object and the adhesion coating enhances an adhesion between the base coating to the object and provides an anti-corrosive effect to the object, the base coating including the adhesion coating and a smoothening coating;

applying, on the adhesion coating of the object, a smoothening coating solution that includes 41.96%-46.38% of Epoxy E-51, 0.22%-0.57% of polyacrylate, 5.77%-5.82% of glycidyl 2-methylphenyl ether (CGE), 4.39%-4.93% of acetone, 23.82%-26.15% of diacetone alcohol, 9.37%-15.61% of butan-1-ol and 6.56%-8.44% of a phenolic aldehyde amine crosslinking agent by weight, such that the smoothening coating of the base coating is formed on the adhesion coating of the object and the smoothening coating improves smoothness of the base coating to enhance an adhesion between the base coating and a silver coating;

oxidizing stannous chloride to obtain a stannous chloride solution that includes a mixture of $Sn^{2+}$ and $Sn^{4+}$ ions; applying, on the object with the base coating, the stannous chloride solution to sensitize the object, to generate a sensitized surface of the object and provide a better adhesion between silver of the silver coating and the epoxy E-51 of the base coating, compared with only using $Sn^{2+}$ ions;

providing a silver nitrate based solution that includes deionized (DI) water, sodium hydroxide, silver nitrate and aqueous ammonia, the silver nitrate having a concentration of 7.5-20 g/L in the silver nitrate based solution;

providing a glucose based solution that includes glucose, citric acid, ethanol and DI water, the glucose having a concentration of 5-20 g/L in the glucose based solution;

cross-spraying, on the sensitized surface of the object, the silver nitrate based solution and the glucose based solution simultaneously at ambient temperature, such that particles from the silver nitrate based solution and the glucose based solution result in a fine vapor format before hitting the sensitized surface and in turn form a silver coating with silver nanoparticles of 30-50 nanometers coated on the smoothening coating of the base coating of the object; and applying, on the silver coating of the object, an anti-scratch coating solution that includes 33.88%-35.26% of methyltrimethoxysilane (MTMS), 3.92%-4.08% of (3-mercaptopropyl)trimethoxysilane (A189), 11.80%-12.28% of butan-1-ol, 1.18%-1.23% of acetic acid, 13.61%-13.69% of DI water, 1.18%-1.23% of 3% colloidal silica, 32.66%-33.99% of Diacetone alcohol, and 0.01%-0.02% of crystal violet such that an anti-scratch coating is formed on the silver coating as to achieve the electroless plating on the surface of the object.

2. The method of claim 1, wherein the applying the adhesion coating further comprises:

degassing the adhesion coating solution by ultrasonication for more than 5 minutes;

spraying DI water onto the object at 22 mL/min and 3 bar and then acetone onto the object;

spraying the adhesion coating solution onto the object for 30 seconds with a spray gun being held at 15 cm away from the object; and heating the object with the adhesion coating solution applied at 150° C. for 15 minutes such that the adhesion coating is coated on the surface of the object.

3. The method of claim 1, wherein the applying the smoothening coating further comprises:

degassing the smoothening coating solution by ultrasonication for more than 10 minutes;

spraying DI water onto the object with the adhesion coating at 55 ml/min and 3 bar and then acetone onto the object;

spraying the smoothening coating solution onto the object with the adhesion coating for 30 seconds with a spray gun being held at 15 cm away from the object; and heating the object with the smoothening coating applied at 80° C. for 3-6 hours such that the smoothening coating is coated onto the adhesion coating of the object.

4. The method of claim 1, wherein the providing of sensitized surface further comprises:

spraying DI water onto the object with the smoothening coating at 10 mL/min and 3 bar, and spraying the stannous chloride solution that is a sensitization solution onto the object with the smoothening coating for 30 seconds with a spray gun being held at 5 cm away from the object such that the surface of the object is sensitized.

5. The method of claim 1, wherein the cross-spraying of the silver nitrate based solution and the glucose based solution further comprises:

cross-spraying simultaneously the silver nitrate based solution at a first feed rate and the glucose based solution at a second feed rate onto the sensitized surface of the object, wherein the first feed rate and the second feed rate are in a ratio ranging from 3:2 to 1:3.

6. The method of claim 1, wherein the cross-spraying of the silver nitrate based solution and the glucose based solution further comprises:

providing a double-headed spray gun that includes a first spray head that sprays water at a spraying rate of 10 mL/min and a second spray head that sprays water at a spraying rate of 20 mL/min, the first spray head and the second spray head being held at 40 cm away from the object; and spraying simultaneously the silver nitrate based solution and the glucose based solution via the first spray head and the second spray head onto the sensitized surface of the object, respectively for 60 seconds.

7. The method of claim 1, wherein the cross-spraying of the silver nitrate based solution and the glucose based solution further comprises:

providing a double-headed spray gun that includes a first spray head that sprays water at a spraying rate of 10 mL/min and a second spray head that sprays water at a spraying rate of 20 mL/min, the first spray head and the second spray head being held at 40 cm away from the object;

spraying the silver nitrate based solution and the glucose based solution simultaneously via the first spray head and the second spray head onto the sensitized surface of the object, respectively for 60 seconds;

washing the object with the applied silver nitrate and glucose based solutions with DI water for 1 minute;

drying the object with the applied silver nitrate and glucose based solutions with compressed air for 30 seconds; and curing the object with the applied silver nitrate and glucose based solutions at 100° C. for 15 minutes such that the silver coating is coated onto the smoothening coating of the object.

8. The method of claim 1, wherein the applying of the anti-scratch coating solution further comprises:

spraying DI water onto the object with the silver coating at 8 mL/min and 3 bar;

spraying the anti-scratch coating solution onto the object with the silver coating for 35 seconds via a spray gun being held at 15 cm away from the object; and heating the object at 150° C. for 3 hours such that the anti-scratch coating is coated onto the silver coating of the surface.

9. A method of electroless plating an object, comprising:

immersing the object into a pretreatment mixture that includes gamma-aminopropyl triethoxysilane (A1100), deionized (DI) water and ethanol to obtain the object with a pretreated surface;

applying, on the pretreated surface of the object, a lower layer mixture of a base coating that includes acetone, ethanol, polyacrylate and a phenolic aldehyde amine crosslinking agent to form a lower layer of the base coating on the surface of the object, the base coating including the lower layer and an upper layer;

applying, on the lower layer of the object, an upper layer mixture of the base coating that includes butan-1-ol, 4-hydroxy-4-methyl-2-pentanone, acetone, glycidyl 2-methylphenyl ether (CGE), polyacrylate, E-51 epoxy and a phenolic aldehyde amine crosslinking agent to form the upper layer on the lower layer of the object;

applying, on the base coating, a stannous chloride solution to provide a sensitized object;

immersing the sensitized object into a mirror coating mixture that includes a solution of $[Ag(NH_3)_2]^+$, a solution of glucose and a solution of butynediol at room temperature such that a mirror coating is formed on the base coating of the object; and immersing the object with the mirror coating into an anti-scratch coating mixture that includes 3-glycidoxypropyltrimethoxysilane (A187), tetraethylsilicate (TEOS) and methyltrimethoxysilane (MTMS), acetic acid, butan-1-ol, and violet dye such that an anti-scratch coating is formed on the mirror coating of the object as to achieve the electroless plating on the surface of the object.

10. The method of claim 9, wherein the object is immersed into the pretreatment mixture and ultrasonicated for more than 10 minutes, oven-dried at 110° C. for more than 20 minutes and then cooled to room temperature such that the pretreatment is completed.

11. The method of claim 9, wherein the applying of the lower layer mixture further comprises:

degassing the lower layer mixture by ultrasonication for more than 5 minutes; and heating the object coated with the lower layer mixture at 50° C. for more than 6 hours such that the lower layer is coated onto the surface of the object.

12. The method of claim 9, wherein the applying of the upper layer mixture further comprises:

degassing the upper layer mixture by ultrasonication for more than 10 minutes; and heating the object coated with the upper layer mixture at 80° C. for more than 4 hours such that the upper layer is coated onto the lower layer of the object.

13. The method of claim 9, wherein the stannous chloride solution is prepared by adding stannous chloride into hydrochloric acid at room temperature, and adding DI water until the stannous chloride has a concentration of 5 g/L and the hydrochloric acid has a concentration of 5 g/L in the stannous chloride solution.

14. The method of claim 13, wherein the applying of the stannous chloride solution further comprises: the object with the base coating is immersed into the stannous chloride solution, rinsed with DI water and dried in oven at 90° C. and cooled down to room temperature.

15. The method of claim 9, wherein the solution of $[Ag(NH_3)_2]^+$ has a concentration of $[Ag(NH_3)_2]^+$ as 10 g/L, and the solution of glucose has a concentration of glucose as 8 g/L, and the solution of butynediol has a concentration of butynediol as 8.6 g/L.

16. The method of claim 15, wherein the forming of the mirror coating mixture further comprises: the solution of glucose and the solution of butynediol are mixed to generate a mixture of glucose and butynediol, the solution of $[Ag(NH_3)_2]^+$ is then added into the mixture of glucose and butynediol such that the solution of $[Ag(NH_3)_2]^+$ and the solution of glucose are mixed at a volume ratio of 1:1-1:2, and the solution of butynediol accounts for 5% of a total volume of the solution of $[Ag(NH_3)_2]^+$ and the solution of glucose.

17. The method of claim 9, wherein the sensitized object is immersed into the mirror coating mixture at room temperature for 4-6 minutes without stirring or vibration such that the mirror coating is formed on the base coating of the object.

18. The method of claim 9, wherein the anti-scratch coating mixture is prepared by mixing the A187, the TEOS and the MTMS at room temperature to obtain a silane mixture; adding DI water and acetic acid to the silane mixture at room temperature; and further adding butan-1-ol and violet dye.

19. The method of claim 18, wherein the object with the mirror coating is immersed into the anti-scratch coating mixture for more than 1 minute, and then heated at 100° C. for more than 18 hours such that the anti-scratch coating is formed on the mirror coating.

* * * * *